US006481253B1

(12) United States Patent
Fan

(10) Patent No.: US 6,481,253 B1
(45) Date of Patent: Nov. 19, 2002

(54) DOOR LOCK-AND-HANDLE ASSEMBLY

(76) Inventor: Fang-Yi Fan, No. 186, Min-Kuo Rd., Chia-Yi City (TW)

( * ) Notice: Subject to any disclaimer, the term of this patent is extended or adjusted under 35 U.S.C. 154(b) by 0 days.

(21) Appl. No.: 10/002,497

(22) Filed: Nov. 15, 2001

(51) Int. Cl.[7] ..... E05B 13/10; E05B 63/14

(52) U.S. Cl. ..... 70/107; 70/110; 70/210; 70/224; 70/478; 70/485; 70/487

(58) Field of Search ..... 70/107, 110, 111, 70/210, 215–217, 224, 478, 483–488; 292/224, 226, DIG. 26

(56) References Cited

U.S. PATENT DOCUMENTS

| | | | | | |
|---|---|---|---|---|---|
| 722,620 | A | * | 3/1903 | Phelps | 70/110 |
| 3,175,377 | A | * | 3/1965 | Russell et al. | |
| 3,196,645 | A | * | 7/1965 | Russell | |
| 3,212,306 | A | * | 10/1965 | Russell et al. | |
| 3,556,576 | A | * | 1/1971 | Nelson et al. | |
| 3,677,591 | A | * | 7/1972 | Waldo | 292/221 |
| 5,301,526 | A | * | 4/1994 | Fann et al. | 70/224 |
| 5,927,777 | A | * | 7/1999 | Kuo et al. | 70/224 X |
| 6,357,807 | B1 | * | 3/2002 | Fan | 292/226 |

FOREIGN PATENT DOCUMENTS

| | | | | |
|---|---|---|---|---|
| CA | 721028 | * | 11/1965 | 70/224 |
| FR | 702564 | * | 1/1931 | 292/226 |

* cited by examiner

*Primary Examiner*—Lloyd A. Gall
(74) *Attorney, Agent, or Firm*—Harness, Dickey & Pierce, P.L.C.

(57) ABSTRACT

A door lock-and-handle assembly includes a housing receiving a latch bolt and a dead bolt, an escutcheon defining a recess and an engaging groove, a handle mounted on the escutcheon and having a driving member, a spindle coupled to the dead bolt and having a rectangular engaging portion, and a locking member received in the recess and operable to move between a locked position, where the locking member engages the driving member and the engaging groove so as to prevent turning of the handle, and an unlocked position, where the locking member disengages from the driving member and the engaging groove. The locking member is formed with an L-shaped opening having first and second rectangular spaces which cooperately define the L-shaped opening. The engaging portion of the spindle is received in the first rectangular space when the locking member is in the unlocked position, and is received in the second rectangular space when the locking member is in the locked position.

3 Claims, 10 Drawing Sheets

DOOR LOCK-AND-HANDLE ASSEMBLY

BACKGROUND OF THE INVENTION

This invention relates to a door lock-and-handle assembly, more particularly to a door lock-and-handle assembly with a locking member that is movable to releasably engage a handle of the door lock-and-handle assembly.

The object of the present invention is to provide a door lock-and-handle assembly with a locking member that is movable to releasably engage a handle of the door lock-and-handle assembly so as to prevent turning of the handle.

SUMMARY OF THE INVENTION

According to the present invention, a door lock-and-handle assembly comprises: a bolt receiving housing adapted to be mounted on an inner side of a door panel; a dead bolt mounted movably in the bolt receiving housing and movable between extended and retracted positions; an escutcheon adapted to be mounted on an outer side of the door panel, aligned with the bolt receiving housing, and having a mounting wall that is formed with a lock receiving recess which is defined by a recess-confining wall, a spindle hole which is defined by a hole-confining wall extending from the recess-confining wall in an axial direction, and at least an engaging groove which is defined by a groove-confining wall extending from the recess-confining wall in a radial direction relative to the axial direction; a handle mounted on the mounting wall of the escutcheon, surrounding the spindle hole, formed with a keyhole that is aligned with the spindle hole in the axial direction, and having a driving member extending through the spindle hole and the lock receiving recess; a spindle adapted to be turned by a key that is inserted into the keyhole, extending through the spindle hole, the lock receiving recess and the door panel in the axial direction, defining an axis in the axial direction, and turnably coupled to the dead bolt so as to move the dead bolt between the extended and retracted positions upon turning about the axis, the spindle having an engaging portion having a generally rectangular cross-section with two opposing short sides and defining a center line that extends along the axis; and at least a locking member received in the lock receiving recess and having a central part formed with an L-shaped spindle opening that is defined by an opening-confining wall and that has a first rectangular space extending in a horizontal direction and having long and short sides, and a second rectangular space which have long and short sides, which extends in a vertical direction relative to the first rectangular space, and which cooperates with the first rectangular space to define the L-shaped spindle opening, the opening-confining wall having an engaging side that confines the long side of the first rectangular space, the locking member having an engaging tongue projecting from the central part and aligned with the engaging groove in the axial direction, the spindle extending through the L-shaped spindle opening in a manner that the engaging portion is received in the L-shaped spindle opening to turnably engage the engaging side of the opening-confining wall of the locking member, the spindle being turnable between a first angular position, where the engaging portion is received in the first rectangular space, and a second angular position, where the engaging portion is received in the second rectangular space, the short side of the second rectangular space having a length that is greater than the length between the center line and the short side of the engaging portion so as to permit rotation of the spindle in the L-shaped spindle opening, the short side of the first rectangular space having a length that is less than the length between the center line and the short side of the engaging portion so that turning of the spindle from the first angular position to the second angular position results in upward pushing engagement between the engaging portion and the engaging side of the opening-confining wall, which, in turn, results in radial movement of the locking member to a locking position in the radial direction, where the engaging tongue extends through the driving member and into the engaging groove to releasably engage the driving member and the engaging groove so as to prevent turning of the handle, and that turning of the spindle from the second angular position to the first angular position results in radial movement of the locking member to an unlocking position in the radial direction, where the engaging tongue disengages from the driving member and the engaging groove so as to permit turning of the handle.

BRIEF DESCRIPTION OF THE DRAWINGS

In drawings which illustrate an embodiment of the invention.

DETAILED DESCRIPTION OF THE PREFERRED EMBODIMENT

FIGS. 1 to 5, 6A and 6B illustrate a preferred embodiment of a door lock-and-handle assembly of this invention that is adapted to be mounted on a door panel 11 which is formed with screw holes 115 and spindle through hole 114.

Figure 7:
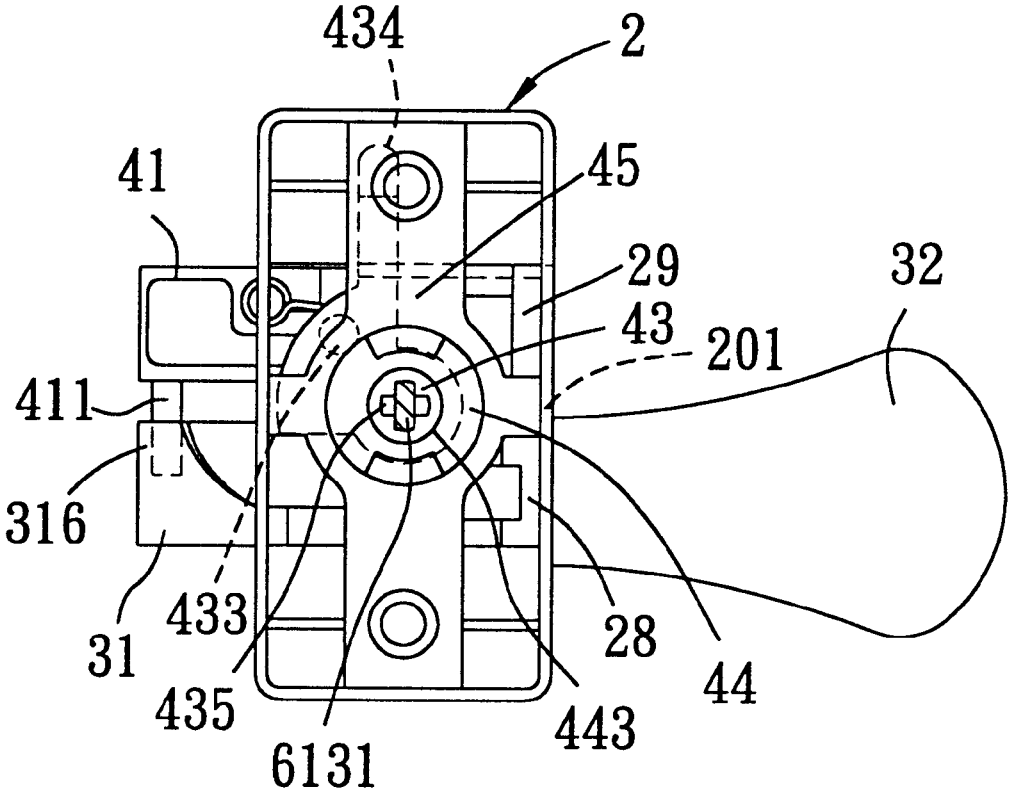
FIG. 7 is a front view of the bolt receiving housing with the dead bolt of FIG. 2 being positioned at an extended position.

The door lock-and-handle assembly is mounted on the door panel 11 via screw means 514 extending through the screw holes 115 and threadedly engaging the door lock-and-handle assembly, and includes: a bolt receiving housing 2 adapted to be mounted on the inner side 111 of the door panel 11 and having a first side wall 21 that is formed with a bolt opening 28; a latch bolt mechanism including a latch bolt 31 mounted movably in the bolt receiving housing 2 and turnable between first extended and retracted positions (see FIGS. 6A and 6B) for moving in and out of the bolt opening 28 into a bolt hole 122 formed in a door frame 12 and offset from the door panel 11, and a latch biasing member 33 that urges the latch bolt 31 to turn toward the first extended position (the latch bolt 31 is forced to turn to the first retracted position against the biasing action of the latch biasing member 33 upon striking a striking plate 123 on the door frame 12); a dead bolt mechanism 4 that includes a dead bolt 41 mounted slidably in the bolt receiving housing 2 adjacent to the latch bolt 31, and slidable in a transverse direction relative to the first side wall 21 between second extended and retracted positions (see FIGS. 1, 5, 7 and 8) for moving in and out of the bolt opening 28; an escutcheon 51 adapted to be mounted on the outer side 112 of the door panel 11, aligned with the bolt receiving housing 2, and having a mounting wall 511 that is formed with a lock receiving recess 516 which is defined by a recess-confining wall, a spindle hole 515 which is defined by a hole-confining wall extending from the recess-confining wall in an axial direction, and at least an engaging groove 518 which is defined by a groove-confining wall extending from the recess-confining wall in a radial direction relative to the axial direction; a handle 52 mounted turnably on the mounting wall 511 of the escutcheon 51, surrounding the spindle hole 515, formed with a keyhole 528 that is aligned with the spindle hole 515 in the axial direction, and having a driving member 525' that extends through the spindle hole 515 and the lock receiving recess 516 and that is turnably coupled to the latch bolt 31 so as to move the latch bolt 31 between the first extended and retracted positions; a spindle 61 adapted to be turned by a key (not shown) that is inserted into the keyhole 528, defining an axis in the axial direction, extending through the spindle hole 515, the lock receiving recess 516, and the spindle through hole 114 in the door panel 11 in the axial direction, and turnably coupled to the dead bolt 41 so as to move the dead bolt 41 between the second extended and retracted positions upon turning about the axis, the spindle 61 having an engaging portion 616; at least a locking member 63 received in the lock receiving recess 516 and having a central part 631 that is formed with a spindle opening 634 defined by an opening-confining wall, and an engaging tongue 633 that projects from the central part 631 and that is aligned with the engaging groove 518 in the axial direction, the spindle 61 extending through the spindle opening 634 in a manner that the engaging portion 616 is received in the spindle opening 634 to turnably engage the opening-confining wall so that turning of the spindle 61 from a first angular position (see FIGS. 1 and 9A) to a second angular position (see FIGS. 8 and 9B) results in radial movement of the locking member 63 to a locked position (see FIG. 8, in combination with FIG. 4), where the engaging tongue 633 extends through the driving member 525' and into the engaging groove 518 to releasably engage the driving member 525' and the engaging groove 518 so as to prevent turning of the handle 52, and that turning of the spindle 61 from the second angular position to the first angular position results in radial movement of the locking member 63 to an unlocked position (see FIG. 1, in combination with FIG. 4), where the engaging tongue 633 disengages from the driving member 525' and the engaging groove 518 so as to permit turning of the handle 52; and a lock releasing member including a driven leg 411 that projects from and that is movable together with the dead bolt 41 so as to be disposed at a position (see FIG. 7) proximate to the latch bolt 31 when the dead bolt 41 is positioned at the second extended position, and so as to be driven by the latch bolt 31 to synchronously move the dead bolt 41 from the second extended position to the second retracted position and the locking member 63 from the locked position to the unlocked position when the latch bolt 31 turns from the first extended position to the first retracted position, thereby permitting turning of the handle 52 and preventing undesirable locking actions of the dead bolt 41 and the locking member 63.

The bolt receiving housing 2 is further formed with upper and lower partitions 29, 29' receiving the dead bolt 41 and the latch bolt 31 respectively therein, and a pair of vertically spaced apart guide rails 261 formed in the upper partition 29 and extending in the transverse direction. The dead bolt 41 is formed with a sliding groove 410 that receives the guide rails 261 so as to guide sliding movement of the dead bolt 41. The latch bolt 31 includes an L-shaped wall that has a first wall portion 313 urged by the latch biasing member 33, and a second wall portion 314 transverse to the first wall portion 313. The latch bolt 31 further includes a curved wall 317 opposite to the first wall portion 313 and extending from and cooperating with one end of the second wall portion 314 to define a leg receiving recess 316 therebetween, and a stopper 315 releasably engaging the first side wall 21 of the bolt receiving housing 2 (see FIG. 6A) when the latch bolt 31 is positioned at the first extended position so as to limit extent of outward movement of the latch bolt 31. The driven leg 411 projects downwardly from a bottom end of the dead bolt 41 and is received in the leg receiving recess 316 when the dead bolt 41 is positioned at the second extended position so as to be driven by the second wall portion 314 when the latch bolt 31 turns from the first extended position to the first retracted position. The first and second wall portions 313, 314 of the latch bolt 31 cooperately define a corner formed with a pivot end 312 that is pivoted to the bolt receiving housing 2 via a pivot pin 35.

The dead bolt 41 is formed with a finger receiving groove 412, and includes a finger urging member 42 disposed adjacent to the finger receiving groove 412. The door lock-and-handle assembly further includes a dead bolt transmission 43 mounted turnably in the bolt receiving housing 2 and including a sector-shaped plate 431 disposed transverse to the first side wall 21 of the bolt receiving housing 2, and a driving finger 433 that projects from the sector-shaped plate 431 in the axial direction, that is received in and that engages the finger receiving groove 412 so as to permit the dead bolt transmission 43 to be turnable about the axis together with the sliding movement of the dead bolt 41, and that is urged by one end 421 of the finger urging member 42 so as to be retained in the finger receiving groove 412. The dead bolt transmission 43 further includes a cylindrical stud 432 that projects from the sector-shaped plate 431 in a direction opposite to the driving finger 433 and that is formed with a spindle engaging hole 435 which receives and which engages the spindle 61 so as to permit synchronous rotation of the dead bolt transmission 43 and the spindle 61 about the axis upon sliding movement of the dead bolt 41. The bolt receiving housing 2 further has a second side wall 22 opposite to the first side wall 21 and a top wall 25. A bolt slot 201 is formed in and extends from the second side wall 22 to the top wall 25. A first bolt operating lever 434 extends outwardly of the bolt receiving housing 2 from the sector-shaped plate 431 through the bolt slot 201 for actuating the dead bolt transmission 43 to move the dead bolt 41 between the second extended and retracted positions.

Figure 1:
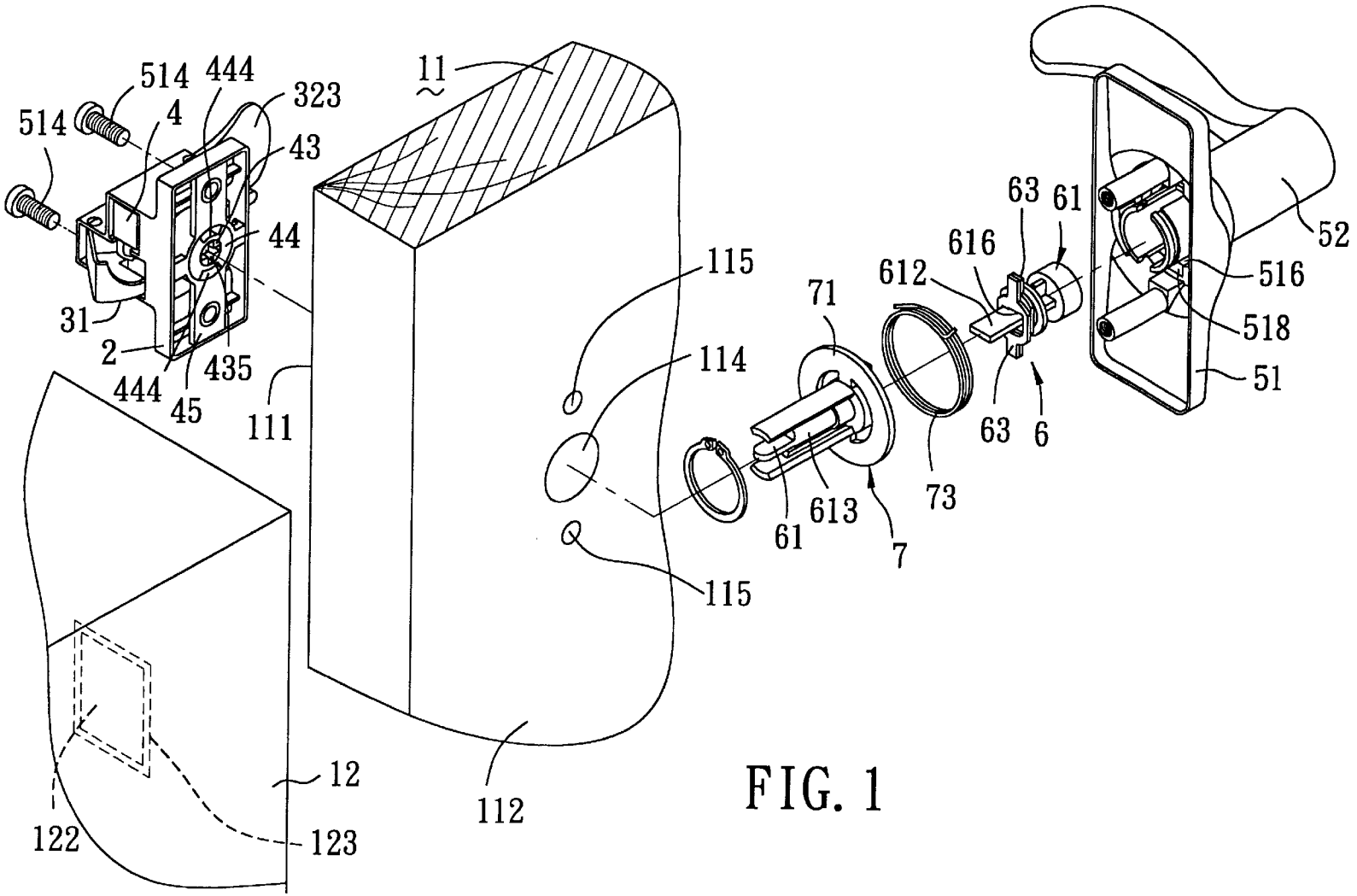
FIG. 1 is an exploded perspective view of a door lock-and-handle assembly embodying this invention.
Figure 2:
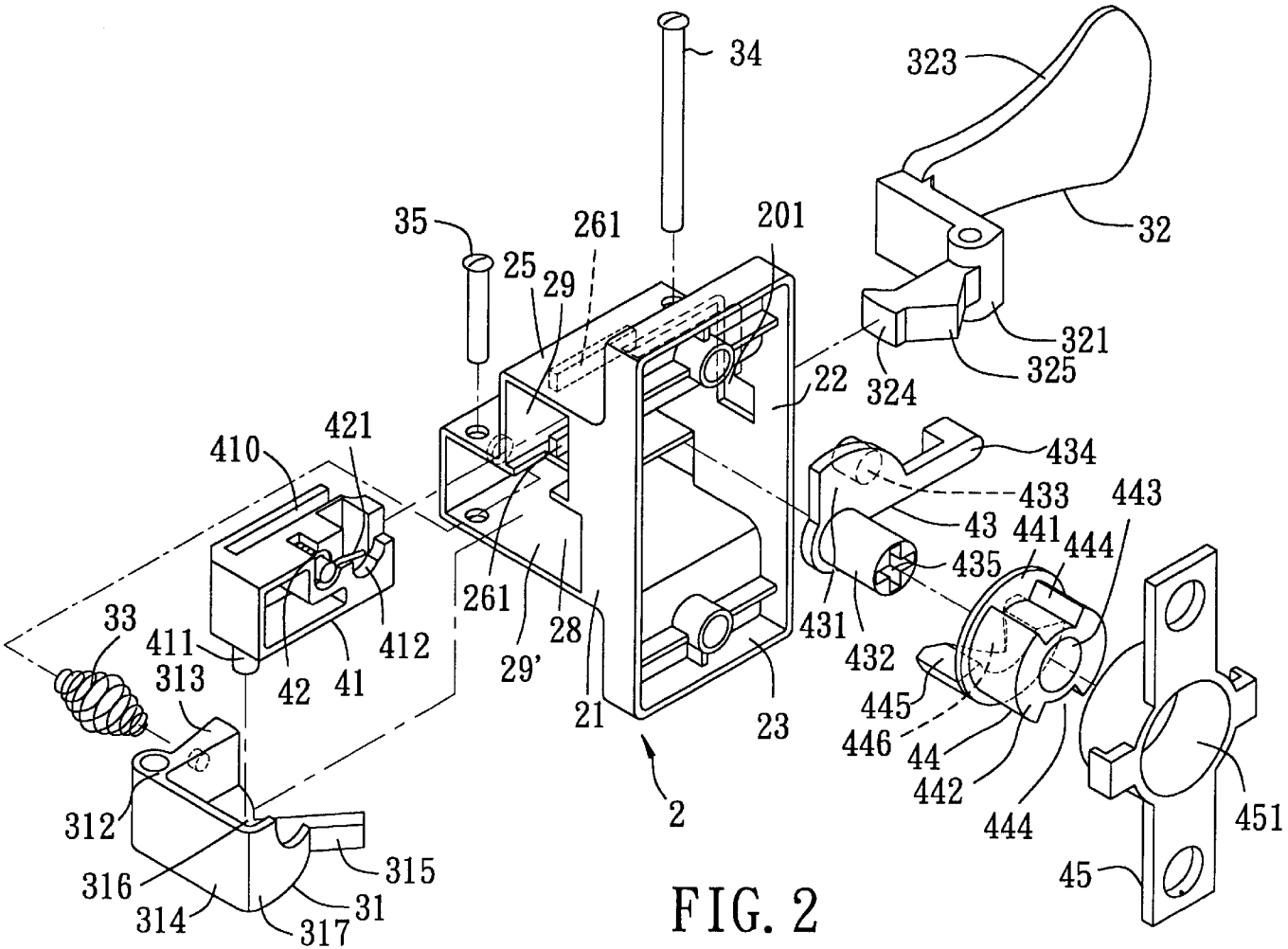
FIG. 2 is an exploded perspective view to illustrate how a latch bolt and a dead bolt of the door lock-and-handle assembly of FIG. 1 are operated.
Figure 3:
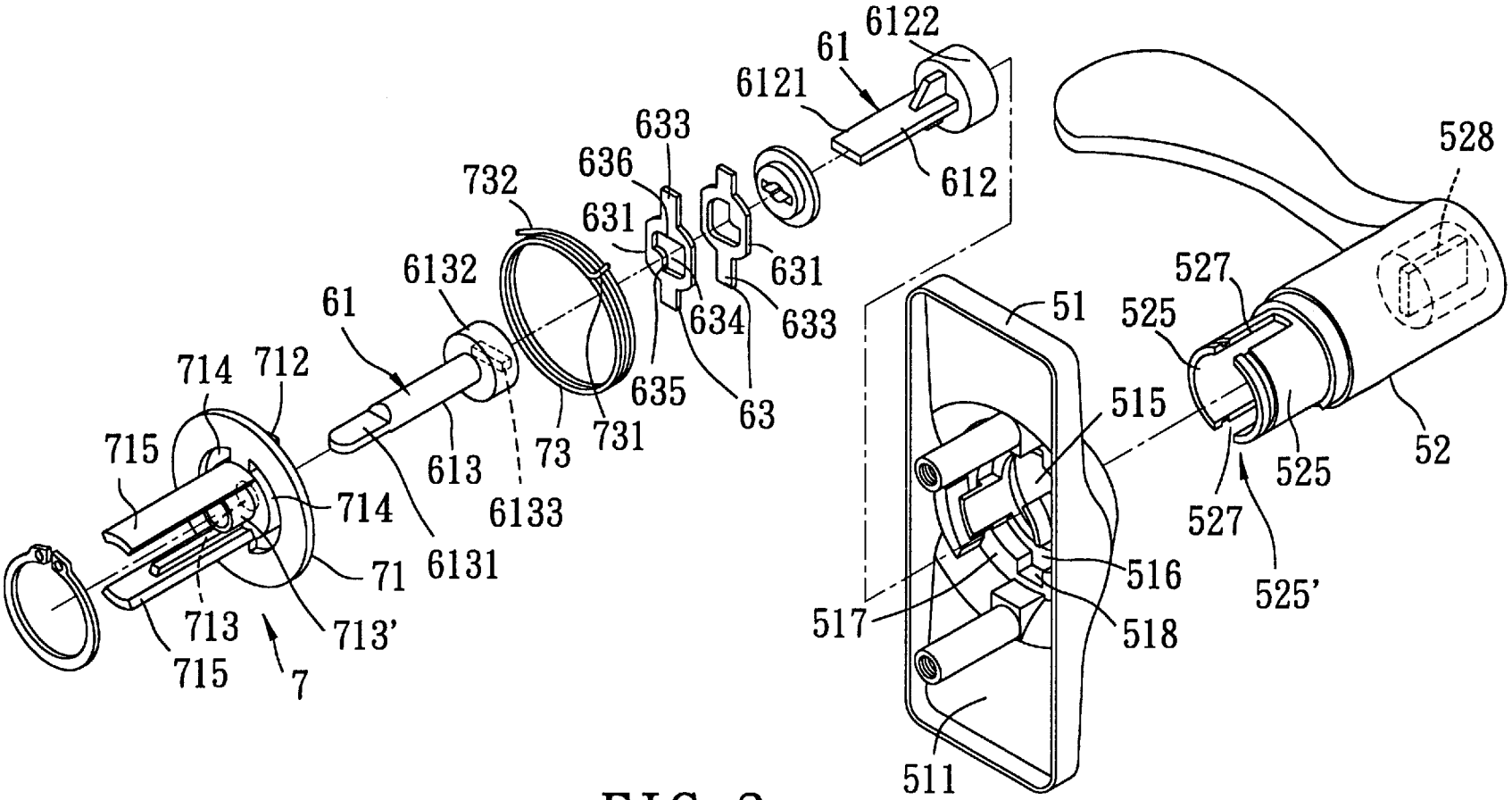
FIG. 3 is an exploded perspective view to illustrate how a locking member, a restoring member, and a handle of the door lock-and-handle assembly of FIG. 1 are operated.
Figure 4:
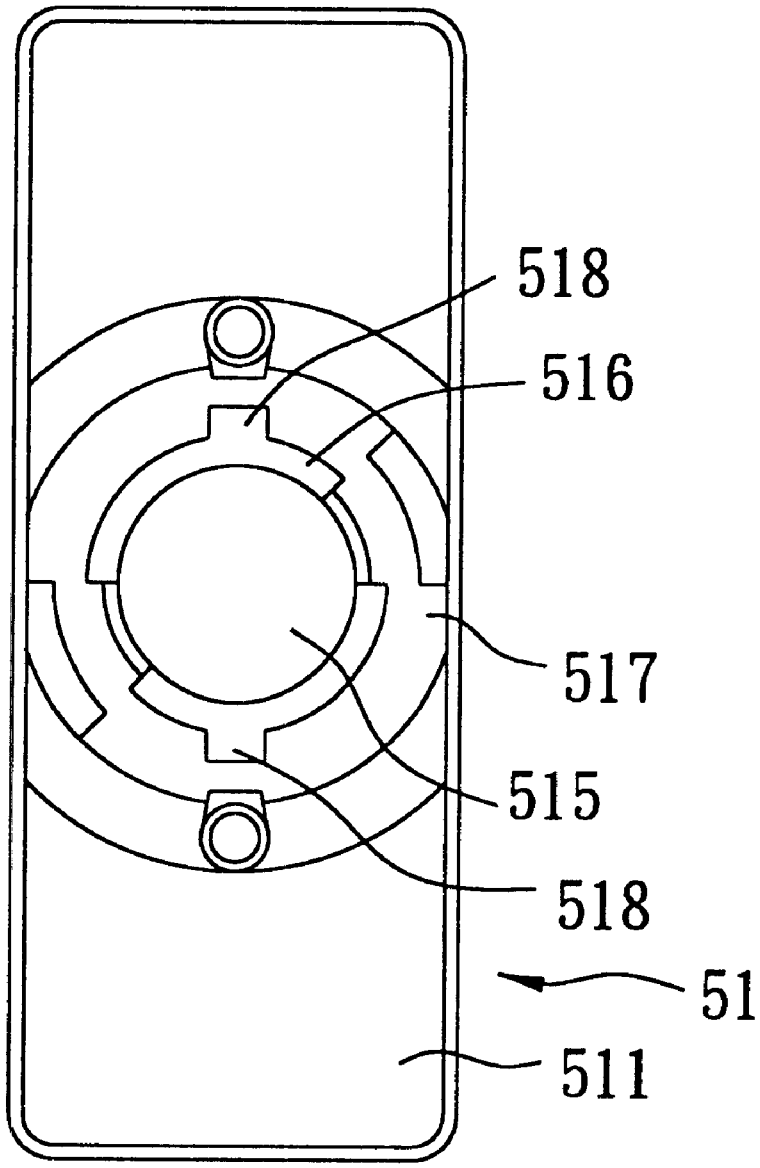
FIG. 4 is a rear view of an escutcheon of the door lock-and-handle assembly of FIG. 1.
Figure 5:
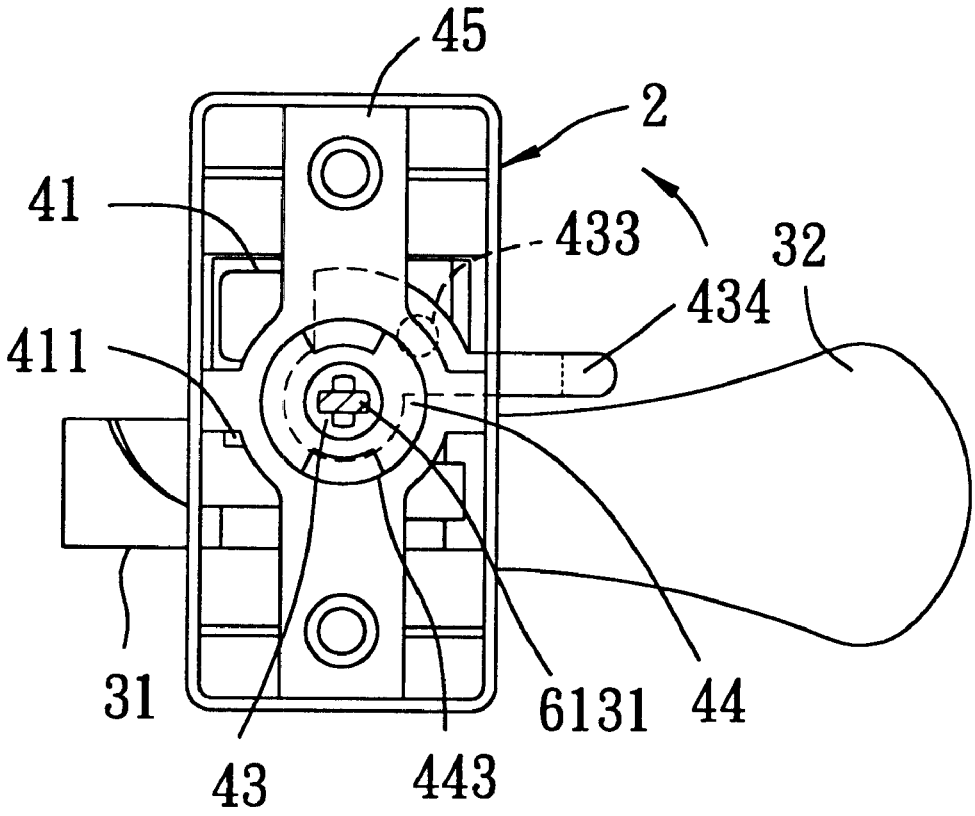
FIG. 5 is a front view of a bolt receiving housing with the latch bolt and the dead bolt of FIG. 2 being received therein.
Figure 6A:
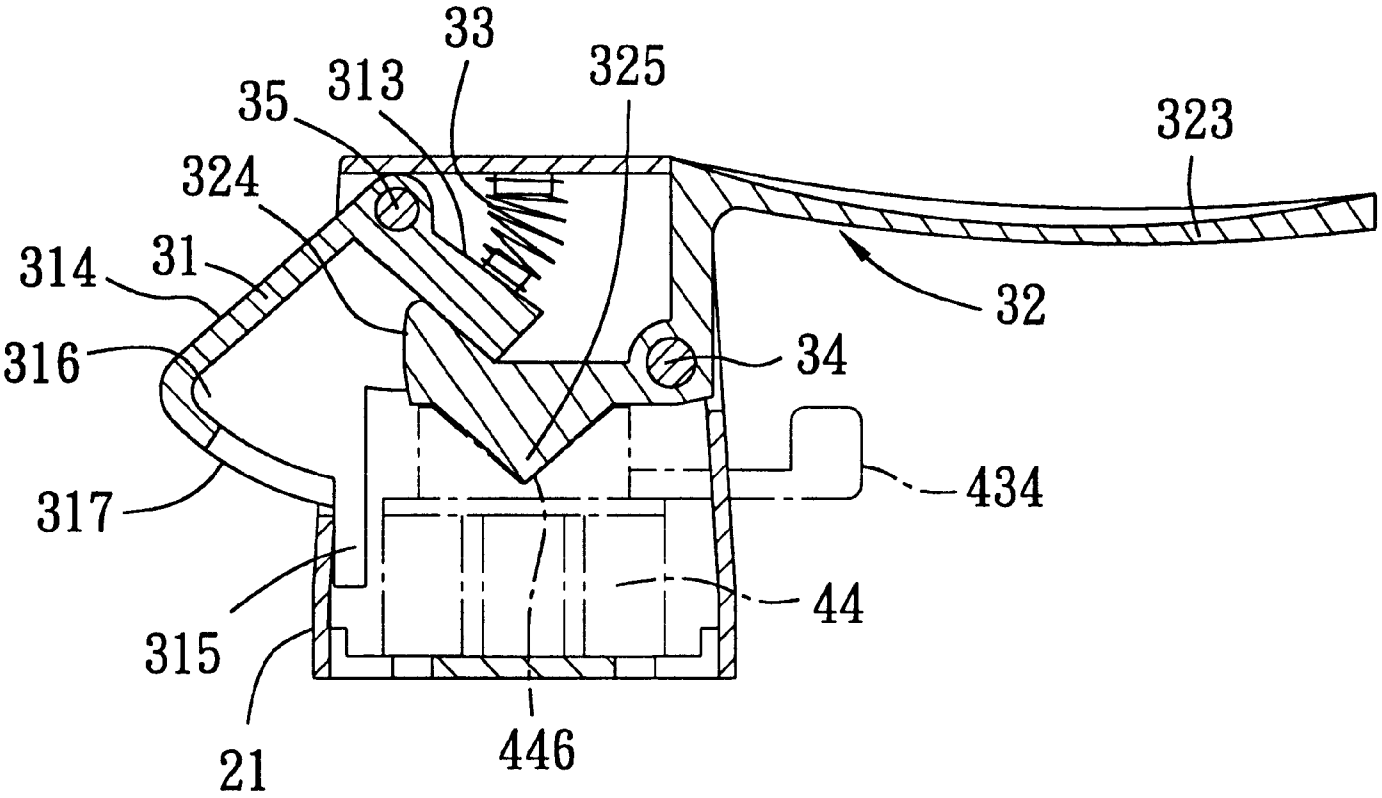
FIGS. 6A and 6B are sectional views to illustrate how the latch bolt of FIG. 2 is turned between extended and retracted positions.
Figure 6B:
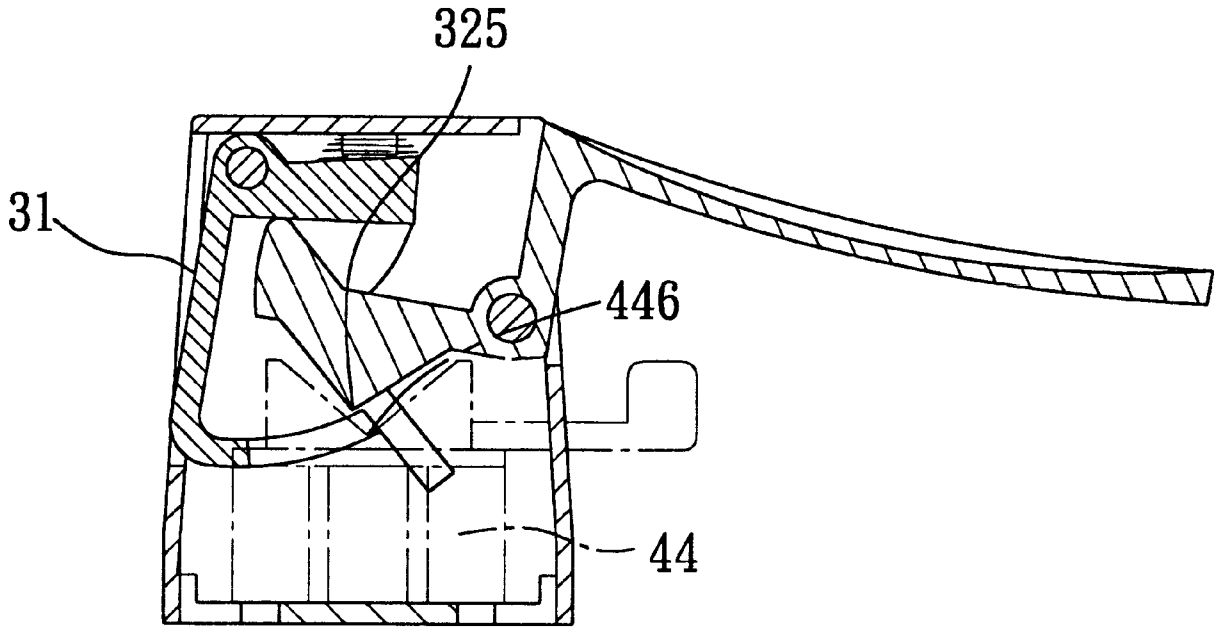
Figure 8:
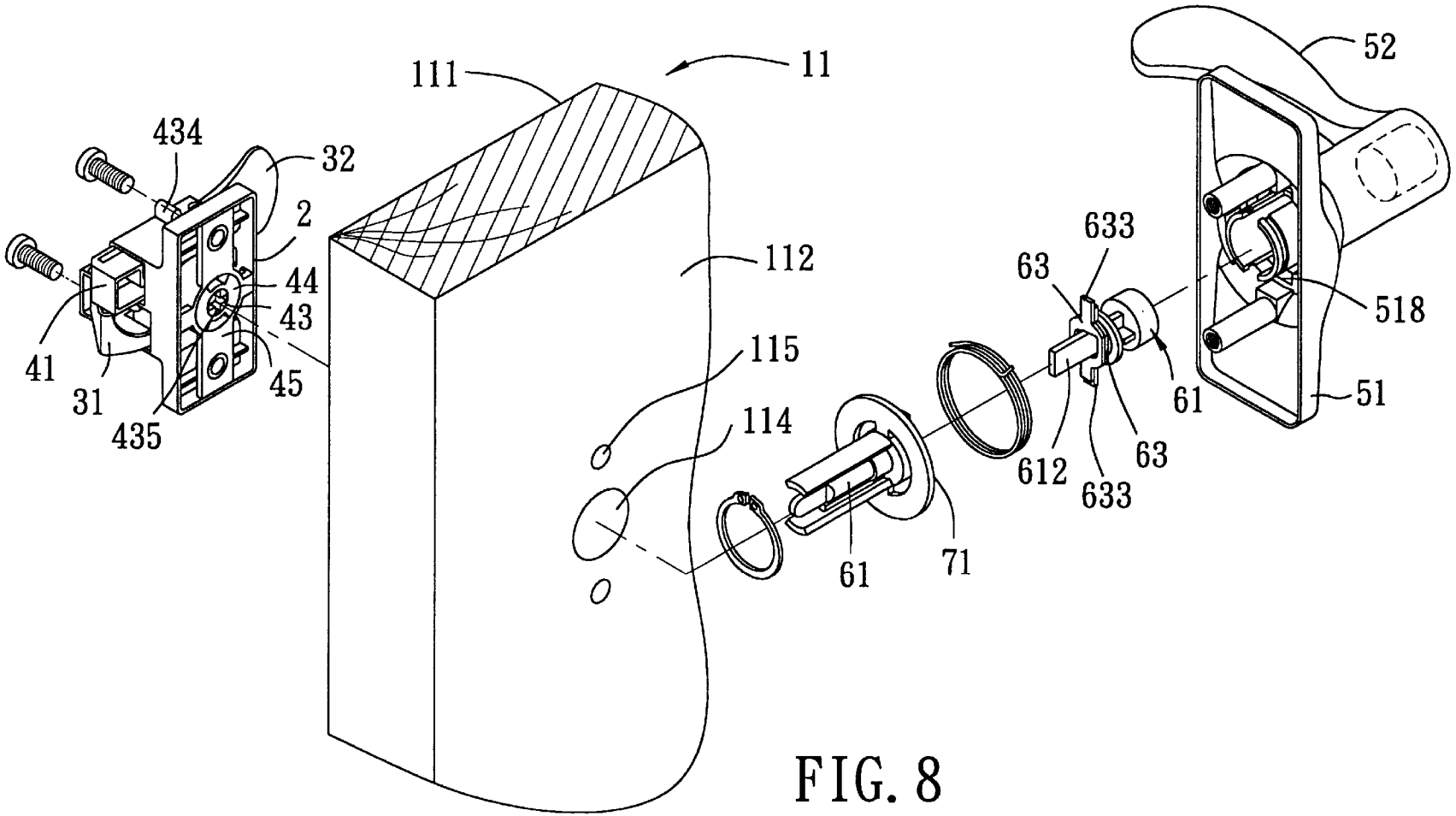
FIG. 8 is an exploded perspective view of the door lock-and-handle assembly of FIG. 1, with the locking member being positioned at a locked position.
Figure 9B:
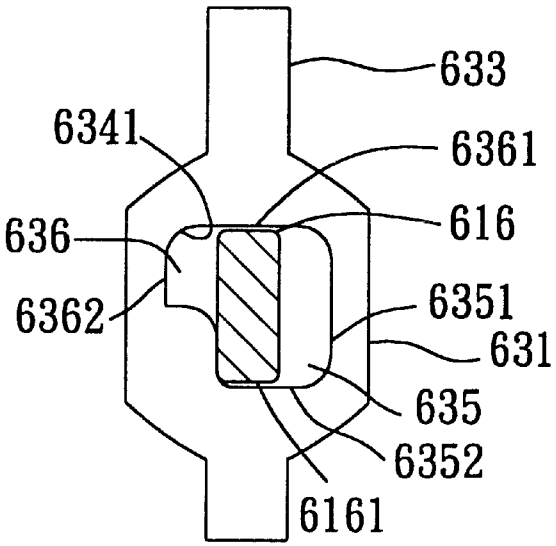
FIGS. 9A and 9B are schematic sectional views to illustrate how the locking member of the door lock-and-handle assembly of FIG. 1 is moved between locked and unlocked positions.
Figure 9A:
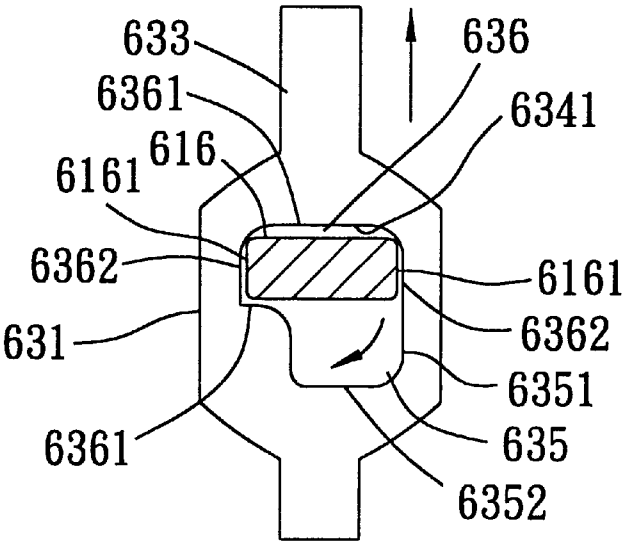

Referring to FIGS. 9A and 9B, in combination with FIGS. 1 and 8, the engaging portion 616 of the spindle 61 has a generally rectangular cross-section with two opposing short sides 6161 and defines a center line extending along the axis. The spindle opening 634 is L-shaped and has a first rectangular space 636 extending in a horizontal direction and having long and short sides 6361, 6362, and a second rectangular space 635 which extends in a vertical direction, which has long and short sides 6351, 6352, and which cooperates with the first rectangular space 636 to define the L-shape of the spindle opening 634. The opening-confining wall has an engaging side 6341 that confines the long side 6361 of the first rectangular space 636. The spindle 61 extends through the spindle opening 634 in a manner that the engaging portion 616 is received in the spindle opening 634 to turnably engage the engaging side 6341 of the opening-confining wall. As shown in FIGS. 1 and 9A, the engaging portion 616 is received in the first rectangular space 636 when the spindle 61 is positioned at the first angular position. As shown in FIGS. 8 and 9B, the engaging portion 616 is received in the second rectangular space 635 when the spindle 61 is positioned at the second angular position. The short side 6352 of the second rectangular space 635 has a length that is greater than the length between the center line and the short side 6161 of the engaging portion 616 so as to permit rotation of the spindle 61 in the spindle opening 634. The short side 6362 of the first rectangular space 636 has a length that is less than the length between the center line and the short side 6161 of the engaging portion 616 so that turning of the spindle 61 from the first angular position to the second angular position results in lifting of the locking member 63 in the radial direction to the locked position via upward pushing engagement between the engaging portion 616 and the engaging side 6341 of the opening-confining wall, and that turning of the spindle 61 from the second angular position to the first angular position results in lowering of the locking member 63 in the radial direction to the unlocked position by virtue of gravity.

Preferably, the mounting wall 51 is formed with two of the engaging grooves 518 that are diametrically opposing to each other, and the door lock-and-handle assembly includes two of the locking members 63 that are juxtaposed in a manner that the first rectangular spaces 636 in the central parts 631 of the locking members 63 are aligned in the axial direction and that the second rectangular spaces 635 in the central parts 631 of the locking members 63 are offset from each other and extend in opposite directions from the respective first rectangular spaces 636. The engaging tongues 633 of the locking members 63 engage the engaging grooves 518, respectively, when the locking members 63 are positioned at the locked position.

The driving member 525' of the handle 52 includes a pair of diametrically disposed arcuate driving levers 525 that extend through the spindle hole 515 and the lock receiving recess 516 and that cooperately define two opposing limiting slots 527 which extend in the axial direction and which are respectively and radially aligned with the engaging grooves 518. The engaging tongues 633 respectively extend through the limiting slots 527 and into the engaging grooves 518 so as to prevent rotation of the handle 52 about the axis when the locking members 63 are positioned at the locked position. The engaging tongues 633 disengage from the limiting slots 527 and the engaging grooves 518 so as to permit rotation of the handle 52 when the locking members 63 are positioned at the unlocked position.

The bolt receiving housing 2 further has a front open end 23, and a transmission mounting plate 45 mounted on the front open end 23 and formed with a central annular flange 451 that projects into the bolt receiving housing 2. The door lock-and-handle assembly further includes a latch bolt transmission 44 disposed turnably in the bolt receiving housing 2, turnable about the axis, and including a first circular plate 441 that extends in the radial direction, a cylindrical driven part 442 that projects from the first circular plate 441 in the axial direction into the annular flange 451, and that is formed with two diametrically disposed lever engaging grooves 444 extending in the axial direction, and a cam follower 445 that projects from the first circular plate 441 in a direction opposite to the cylindrical driven part 442 and that is formed with a V-shaped groove 446. The mounting wall 511 of the escutcheon 51 is further formed with an outer recess 517 radially spaced apart from the lock receiving recess 516. The door lock-and-handle assembly further includes a latch coupling member 7 that is turnable about the axis, and that includes a second circular plate 71 which is disposed in the outer recess 517, which extends in the radial direction, which is formed with a pair of diametrically disposed arcuate slots 714, and a pair of diametrically disposed arcuate coupling levers 715 which project from the second circular plate 71 through the spindle through hole 114 in the door panel 11 and into the lever engaging grooves 444. The driving levers 525 respectively extend through and engage the arcuate slots 714 so as to permit synchronous rotation of the latch coupling member 7 and the latch bolt transmission 44 about the axis upon turning of the handle 52. The door lock-and-handle assembly further includes a latch operating member 32 that is turnably associated with the latch bolt 31 and the latch bolt transmission 44 and that includes a pressing end 324 which is capable of pressing the wall 313 of the latch bolt 31 against the biasing action of the latch biasing member 33 so as to move the latch bolt 31 from the first extended position to the first retracted position upon turning of the latch operating member 32. The latch operating member 32 further includes a V-shaped cam portion 325 that extends from the pressing end 324 and that engages the V-shaped groove 446 in a cam mechanism manner so as to permit turning of the latch operating member 32 via synchronous rotation of the latch coupling member 7 and the latch bolt transmission 44 upon turning of the handle 52, thereby permitting displacement of the latch bolt 31 from the first extended position to the first retracted position. The latch operating member 32 further includes a latch operating lever 323 that extends outwardly of the bolt receiving housing 2 from one end of the V-shaped cam portion 325, and that has a pivot end 321 pivoted to the top wall 25 of the bolt receiving housing 2 via a pivot pin 34.

The latch coupling member 7 further includes an abutting protrusion 712 that projects from the second circular plate 71 toward the lock receiving recess 516. The door lock-and-handle assembly further includes a restoring member 73 disposed in the outer recess 517 between the latch coupling member 7 and the mounting wall 511 and having one end 731 that abuts against the mounting wall 511, and the other end 732 that abuts against the abutting protrusion 712 so as to permit restoring of the handle 52, the latch coupling member 7 and the latch bolt transmission 44 from an actuating position to a non-actuating position.

The first circular plate 441 and the cylindrical driven part 442 are formed with a first spindle through-hole 443. The cylindrical stud 432 is turnably received in the first spindle through-hole 443. The latch coupling member 7 further includes an annular spindle confining flange 713' that projects from the second circular plate 71 in the axial direction. The spindle confining flange 713' and the second circular plate 71 are formed with a second spindle through-hole 713. The spindle 61 includes first and second sections 613, 612. The first section 613 of the spindle 61 extends through the second spindle through-hole 713, and has a driving end 6131 extending into and engaging the spindle engaging hole 435 in the cylindrical stud 432, and an enlarged connecting end 6132 that is formed with a coupling groove 6133. The second section 612 of the spindle 61 extends through the spindle opening 634 in the central part 631 of each of the locking members 63 and has one end 6121 inserted fittingly into the coupling groove 6133, and the other end 6122 extending through the spindle hole 515 in the mounting wall 511 of the escutcheon 51 and adapted to be driven by the key inserted in the keyhole 528 in the handle 52.

Referring to FIG. 8, in combination with FIG. 1, in case the dead bolt 41 is undesirably positioned at the second extended position when the door panel 11 is moving toward the door frame 12, as the latch bolt 31 strikes the striking plate 123 on the door frame 12 and is forced to turn to the first retracted position, the driven leg 411 on the dead bolt 41 will be moved by the latch bolt 31 so as to move the dead bolt 41 from the second extended position to the second retracted position, which, in turn, moves the locking members 63 to the unlocked position via synchronous rotation of the dead bolt transmission 43 and the spindle 61 so as to permit turning of the handle 52 when the latch bolt 31 is received in the bolt hole 122, thereby preventing undesirable locking of the dead bolt 41 in the bolt hole 122.

With the invention thus explained, it is apparent that various modifications and variations can be made without departing from the spirit of the present invention. It is therefore intended that the invention be limited only as recited in the appended claims.

I claim:

1. A door lock-and-handle assembly adapted to be mounted on a door panel having inner and outer sides, said door lock-and-handle assembly comprising:

a bolt receiving housing adapted to be mounted on the inner side of the door panel;

a dead bolt mounted movably in said bolt receiving housing and movable between extended and retracted positions;

an escutcheon adapted to be mounted on the outer side of the door panel, aligned with said bolt receiving housing, and having a mounting wall that is formed with a lock receiving recess which is defined by a recess-confining wall, a spindle hole which is defined by a hole-confining wall extending from said recess-confining wall in an axial direction, and at least an engaging groove which is defined by a groove-confining wall extending from said recess-confining wall in a radial direction relative to said axial direction;

a handle mounted on said mounting wall of said escutcheon, surrounding said spindle hole, formed with a keyhole that is aligned with said spindle hole in said axial direction, and having a driving member extending through said spindle hole and said lock receiving recess;

a spindle adapted to be turned by a key that is inserted into said keyhole, extending through said spindle hole, said lock receiving recess and the door panel in said axial direction, defining an axis in said axial direction, and turnably coupled to said dead bolt so as to move said dead bolt between said extended and retracted positions upon turning about said axis, said spindle having an engaging portion having a generally rectangular cross-section with two opposing short sides and defining a center line that extends along said axis; and at least a locking member received in said lock receiving recess and having a central part formed with an L-shaped spindle opening that is defined by an opening-confining wall and that has a first rectangular space extending in a horizontal direction and having long and short sides, and a second rectangular space which has long and short sides, which extends in a vertical direction relative to said first rectangular space, and which cooperates with said first rectangular space to define said L-shaped spindle opening, said opening-confining wall having an engaging side that confines said long side of said first rectangular space, said locking member having an engaging tongue projecting from said central part and aligned with said engaging groove in said axial direction, said spindle extending through said L-shaped spindle opening in a manner that said engaging portion is received in said L-shaped spindle opening to turnably engage said engaging side of said opening-confining wall of said locking member, said spindle being turnable between a first angular position, where said engaging portion is received in said first rectangular space, and a second angular position, where said engaging portion is received in said second rectangular space, said short side of said second rectangular space having a length that is greater than the length between said center line and said short side of said engaging portion so as to permit rotation of said spindle in said L-shaped spindle opening, said short side of said first rectangular space having a length that is less than the length between said center line and said short side of said engaging portion so that turning of said spindle from said first angular position to said second angular position results in upward pushing engagement between said engaging portion and said engaging side of said opening-confining wall, which, in turn, results in radial movement of said locking member to a locking position, where said engaging tongue extends through said driving member and into said engaging groove to releasably engage said driving member and said engaging groove so as to prevent turning of said handle, and that turning of said spindle from said second angular position to said first angular position results in radial movement of said locking member to an unlocking position, where said engaging tongue disengages from said driving member and said engaging groove so as to permit turning of said handle.

2. The door lock-and-handle assembly of claim 1, wherein said mounting wall is formed with two of said engaging grooves that are diametrically opposite to each other, said door lock-and-handle assembly comprising two of said locking members that are juxtaposed in a manner that said first rectangular spaces in said central parts of said locking members are aligned in said axial direction and that said second rectangular spaces in said central parts of said locking members are offset from each other and extend in opposite directions from the respective first rectangular spaces, said engaging tongues of said locking members engaging said driving member and said engaging grooves, respectively, when said locking members are positioned at said locking position.

3. The door lock-and-handle assembly of claim 2, wherein said driving member includes a pair of diametrically disposed arcuate driving levers that extend through said spindle hole and said lock receiving recess and that cooperately define two opposing limiting slots which extend in said axial direction and which are respectively and radially aligned with said engaging grooves, said engaging tongues respectively extending through said limiting slots and into said engaging grooves so as to engage said arcuate driving levers and said engaging tongues and so as to prevent turning of said handle about said axis when said locking members are turned to said locking position via rotation of said spindle, said engaging tongues disengaging from said arcuate driving levers and said engaging grooves so as to permit rotation of said handle when said locking members are turned to said unlocking position via rotation of said spindle.

* * * * *